US005904015A

United States Patent [19]

Chen

[11] Patent Number: 5,904,015

[45] Date of Patent: May 18, 1999

[54] COVER PLATE CONNECTING STRUCTURE OF A NETWORK FLOOR

[76] Inventor: Yao-Chung Chen, 7F, No. 214, Sec.3, Ta-Tung Rd., Hsi-Chien Chen, Taipei Hsien, Taiwan

[21] Appl. No.: 08/896,766

[22] Filed: Jul. 18, 1997

[51] Int. Cl.[6] ..... E04F 15/024

[52] U.S. Cl. ..... 52/220.2; 52/220.5; 52/220.6; 52/263

[58] Field of Search ..... 52/263, 220.1, 52/220.2, 220.3, 220.4, 220.8, 220.5, 220.6

[56] References Cited

U.S. PATENT DOCUMENTS

| | | | |
|---|---|---|---|
| 4,773,196 | 9/1988 | Yoshida et al. | 52/263 X |
| 5,031,369 | 7/1991 | Kobayashi et al. | 52/263 X |
| 5,400,554 | 3/1995 | Lo | 52/263 X |
| 5,434,355 | 7/1995 | Sho | 52/220.3 X |
| 5,459,968 | 10/1995 | Jin | 52/263 X |
| 5,628,157 | 5/1997 | Chen | 52/263 |
| 5,630,300 | 5/1997 | Chen | 52/220.1 X |
| 5,640,821 | 6/1997 | Kock | 52/263 X |

*Primary Examiner*—Christopher Kent
*Assistant Examiner*—Yvonne Harton-Richardson
*Attorney, Agent, or Firm*—Varndell Legal Group

[57] ABSTRACT

The present invention is directed to a connecting structure of a cover plate for a network floor. The floor supports or floor plate bodies for the network floor are integrally formed with a hollow portion, a frame rim portion, and a central pillar on the center portion the floor supports or floor plate bodies. Locking rims are provided on the periphery of the cover plate which engage with grooves provided in the frame rim portion of the floor supports or in the floor plate bodies. Long side covers are also provided and have rim portions extending downward on the long sides thereof. The rim portions of the long side covers also engage the grooves of the frame rim portion of the floor supports or the floor plate bodies. In addition, a central cover is provided that has locking rims which engage grooves of the two adjacent floor supports or floor plate bodies. The assembled structure has improved strength that prevents the network floor from sliding or deforming.

6 Claims, 7 Drawing Sheets

COVER PLATE CONNECTING STRUCTURE OF A NETWORK FLOOR

FIELD OF THE INVENTION

The present invention is directed to a cover plate connecting structure of a network floor, which is suitable for use in raised or network floors that are widely used in offices, conference rooms, homes, etc. The design of the present invention provides improved strength, so that the lifetime of the network floor is prolonged and the corners of the network floor do not deform over time.

DESCRIPTION OF THE PRIOR ART

There are products on the market related to raised floors (or "network floors"). Basically, the structure of these floors is mainly comprised of floor supports, connecting bases, central covers, covers on the floor boundary, line groove bases, etc. In these floors the connecting manner of the central covers, the boundary covers and the floor supports all use a plate cover to cover the area between two floor supports. However, in this prior technology, since the floor surface can suffer from treading or walking and the rolling of heaving loads thereon, the cover can become deformed at its corners. On the other hand or owing to the displacement of edge on the floor support unit, the floor can crack, which deteriorates from the appearance and safety of the floor.

In an improvement, a tenon piece was installed on the long sides of the cover plate for insertion into the floor support, and further, a line groove base was designed for connecting with connecting bases. In this arrangement after the floor was assembled, all the floor support units were connected strongly, and the design of the line groove base had the function of making the assembly proceed more quickly. However, while this network floor provided a large amount hollow space, the floor surface did not have sufficient rigidity. Although a downward tenon piece was arranged on the long side of the cover, the two ends of the long side were still deformed by the pressure from the rolling wheels or by people walking thereon. These deficiencies provided the motivation for development of the present invention.

Therefore, since there are drawbacks or deficiencies in the assembly of prior raised or network floor, the inventor of the present invention has invented a new floor to eliminate such drawbacks or deficiencies.

SUMMARY OF THE INVENTION

Accordingly, an object of the present invention is to provide a cover plate connecting structure of a network floor that can be effectively connected with the network floor, where the rigidity strength of the floor surface and the cover are improved, the assembly is easy and matches worldwide specifications, and the floor has low cost and a prolonged lifetime. A further object of the present invention is to provide a cover plate connecting structure of a network floor that can prevent the cover plate from sliding thereby preventing danger associated with the network floor, such as people walking on the floor and falling down.

In order to achieve these objects, the present invention provides a connecting structure for the cover plate of a network floor, which network floor comprises a floor support, a connecting base, a line groove base, a central cover, and a long side cover that are connected together to provide a secure and slide free surface. In the structure of the present invention the distance between the legs of the floor support is larger than that in the prior art, thus the floor support of the present invention has more space for containing wires and cables. Further, in the present invention the floor supports are integrally formed with a hollow portion, a frame rim portion, and a central pillar located at the center portion of the floor supports. The frame rim portion of the floor supports is connected to the central pillar by a strip plate, and locking rims on the periphery of the metal main cover engaged within locking grooves located in the frame rim portion. Locking rims extend downwards from the long sides of the long side cover, and locking grooves are provided in the periphery of the top of the frame rim portion, so that the locking groove of the frame rim portion engages with the locking rim of the metal main cover, and they are fixed together. With this arrangement the top surface of the network floor is strengthened. Meanwhile, the locking rims of the central cover and the long side cover engage the locking grooves of the two adjacent floor supports. The assembled structure of the present invention has improved strength of connection, and improved integral structure, fixedness, and stability. In the present invention, since a plurality of locking rims are provided on the long sides of the long side cover, the strength of the long side cover is increased, thus any deformation resulting from heavy bearing loads or rolling pressures is diminished.

BRIEF DESCRIPTION OF THE DRAWINGS

The present invention will be better understood and its numerous objects and advantages will become apparent to those skilled in the art by referencing to the following drawings in which.

DESCRIPTION OF THE PREFERRED EMBODIMENT

Figure 1:
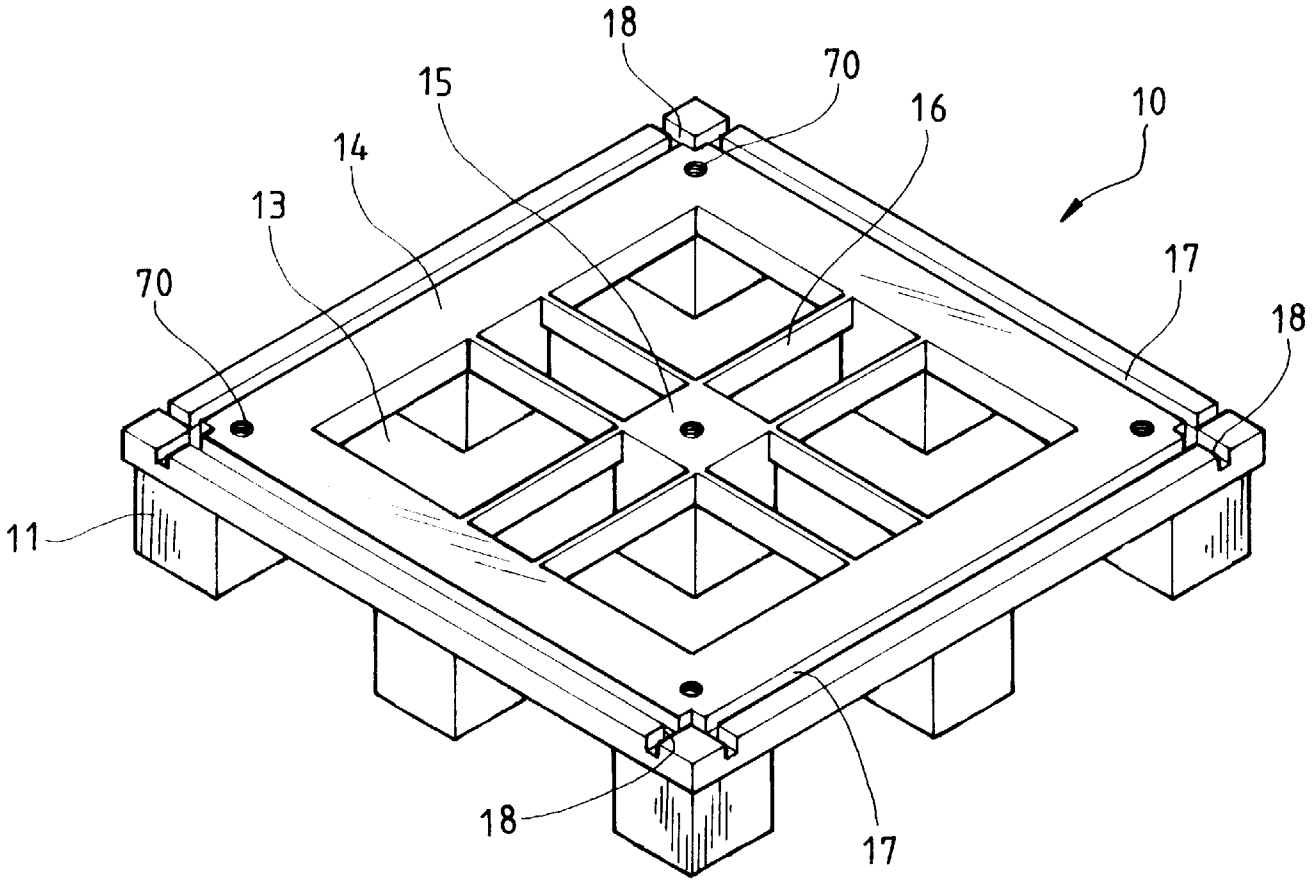
FIG. 1 is the perspective view of the high supporting floor unit in the embodiment of the present invention.
Figure 2:
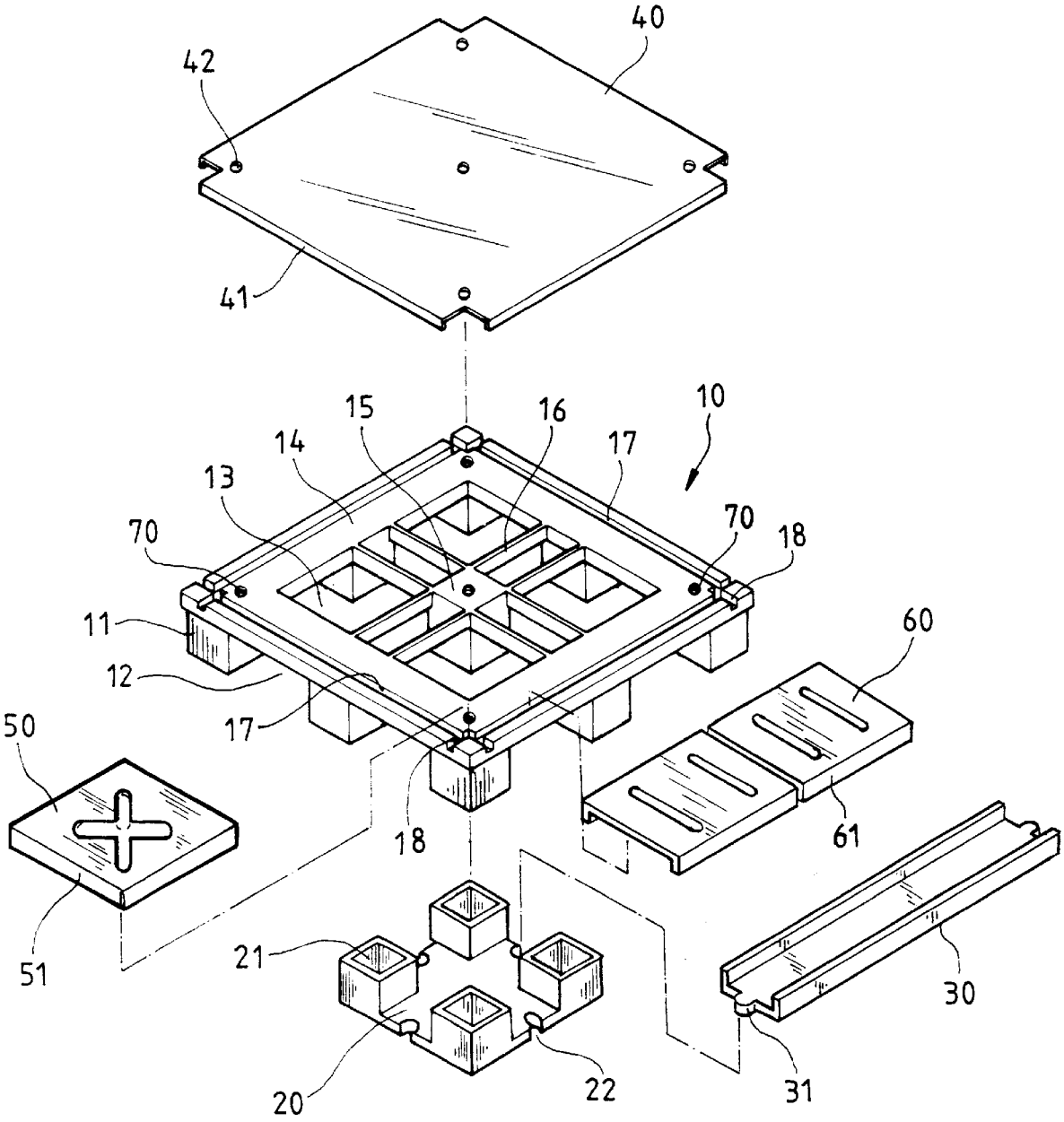
FIG. 2 is the structural exploded view of the network floor of the embodiment in the present invention.

As shown in FIGS. 1 and 2, the network floor of the present invention includes a floor support 10, a connecting base 20, a line groove base 30, a metal main cover 40, a central cover 50 and a long side cover 60.

The floor support 10 in the present invention can made of a plastic material, such as ABS or PC, and is formed integrally. The distance and space between the legs 11 of the floor support is larger than in the prior art, and thus the network floor of the present invention has a space or opening 12 of higher capacity than in the prior art. The floor support 10 of the present invention has an integrally formed structure including a hollow portion 13, a frame rim portion 14, a central pillar 15 connected with the frame rim portion 14 by a strip plates 16, a plurality of screw holes 70 distributed on the periphery on the frame rim portion 14 and on said central pillar, and a plurality of locking grooves 17, 18 are provided on the periphery of the top of the frame rim portion 14.

The connecting base 20 is a rectangular body and includes a plurality of trunks 21 arranged on the periphery of the connecting base 20. The openings of the trunks 21 are directed upwards, so that the legs 11 on the four corners of the floor support 10 can be inserted into the trunks 21. A plurality of grooves 22 are provided on the four edges of the bottom plate of the base 20 for connecting with the line groove base 30. The two short sides of the line groove base 30 are provided with tenons 31 that fit into the grooves 22 of the connecting base 20.

A plurality of locking rims 41 are provided on the periphery of the metal main cover 40, and the center and the four corners of the main cover 40 have screw holes 42. A plurality of locking rims 51 are also arranged on the periphery of the central cover 50. A plurality of locking rims 61 are further arranged on the two long sides of the long side cover 60 and extend downward.

By the aforementioned components, it is easy to precisely positioning the components of the present invention when the connecting bases 20 are installed. By the combination and outward extension of the connecting bases 20 and the line groove bases 30, a framework for the network floor of the present invention including a connecting base for the legs of the floor support can be arranged precisely. Further, after the floor support 10 is engaged with the connecting base 20 and the metal main cover 40 is fixed thereon, the central cover 50 is arranged over the corner of the floor support with locking rims engaging the locking groove 18 of the floor support, while the locking rim 61 on the two long sides of the long side cover 60 is fitted into the locking groove 17, and thus the combination of two floor supports 10 are secured in position to prevent sliding. Since the locking rim 61 extends continuously on the two long sides of the long side cover 60, it has the strength to prevent bending along the long axis of the long side cover 60. Even if the integral body is pressed by a heavy load, it will not bend the front and end portions.

Figure 3:
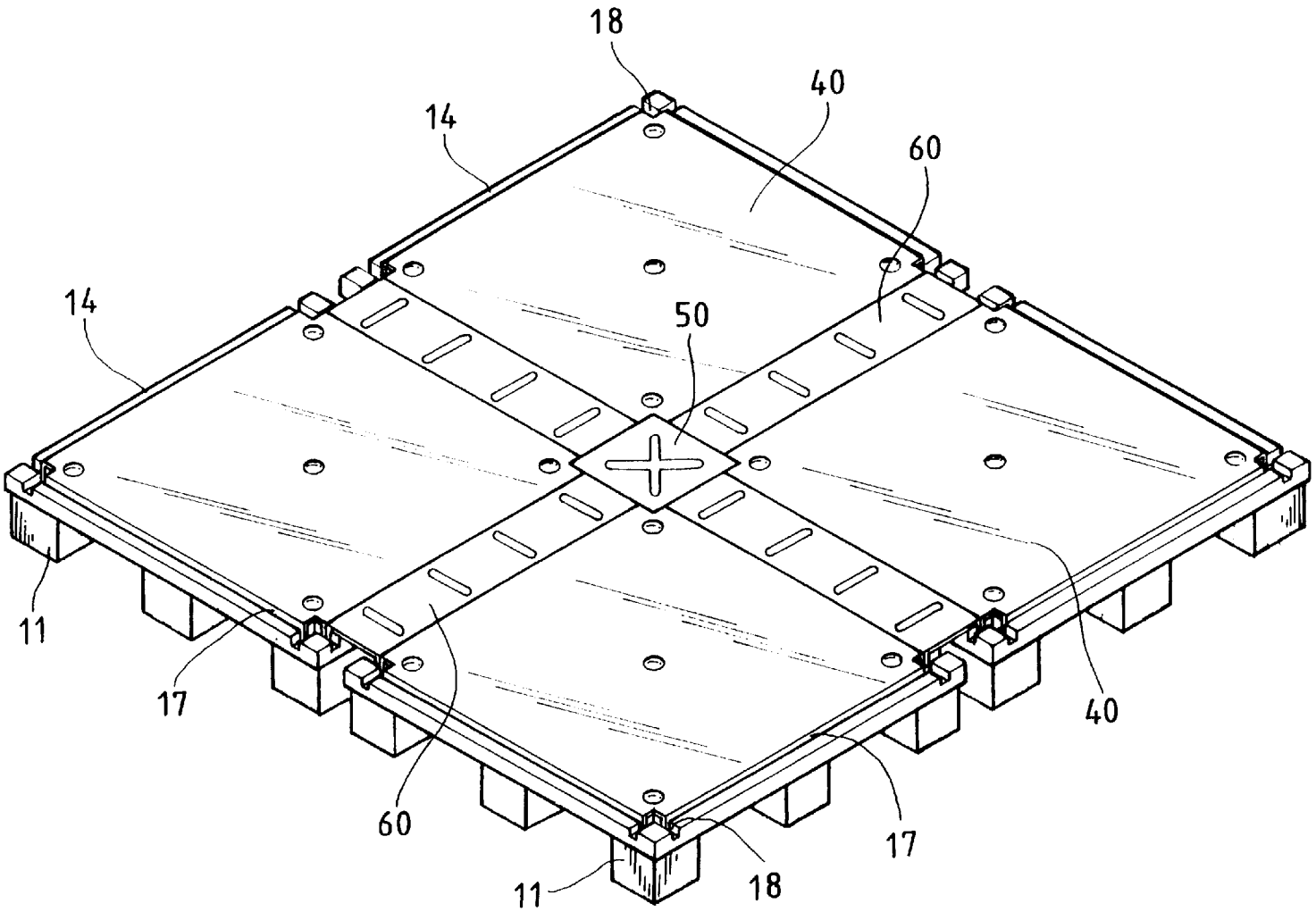
FIG. 3 is the schematic perspective view of the embodiment in the present invention after assembling.
Figure 4:
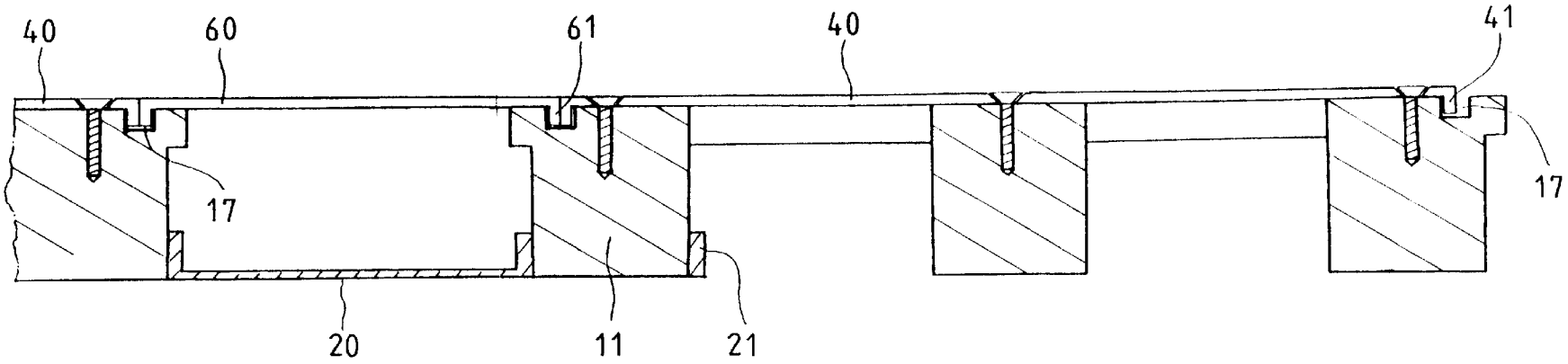
FIG. 4 is a transverse cross sectional view of the embodiment in the present invention after assembling.

FIGS. 3 and 4 are combination and cross sectional views of the network floor of the present invention, which is not adhered to carpet. It will be appreciated that the downward extending locking rim 61 of the long side cover 60 tightly connected the floor supports 10 together and that the the long side cover 60 abuts the central cover 50. This combination of components provides strength and prevents sliding, thereby providing a network floor that is tightly positioned. The metal main cover 40 covers a large plane and has sufficient strength to withstand pressure, so that it has rigidity and will not be affected by periodic loading.

Figure 5:
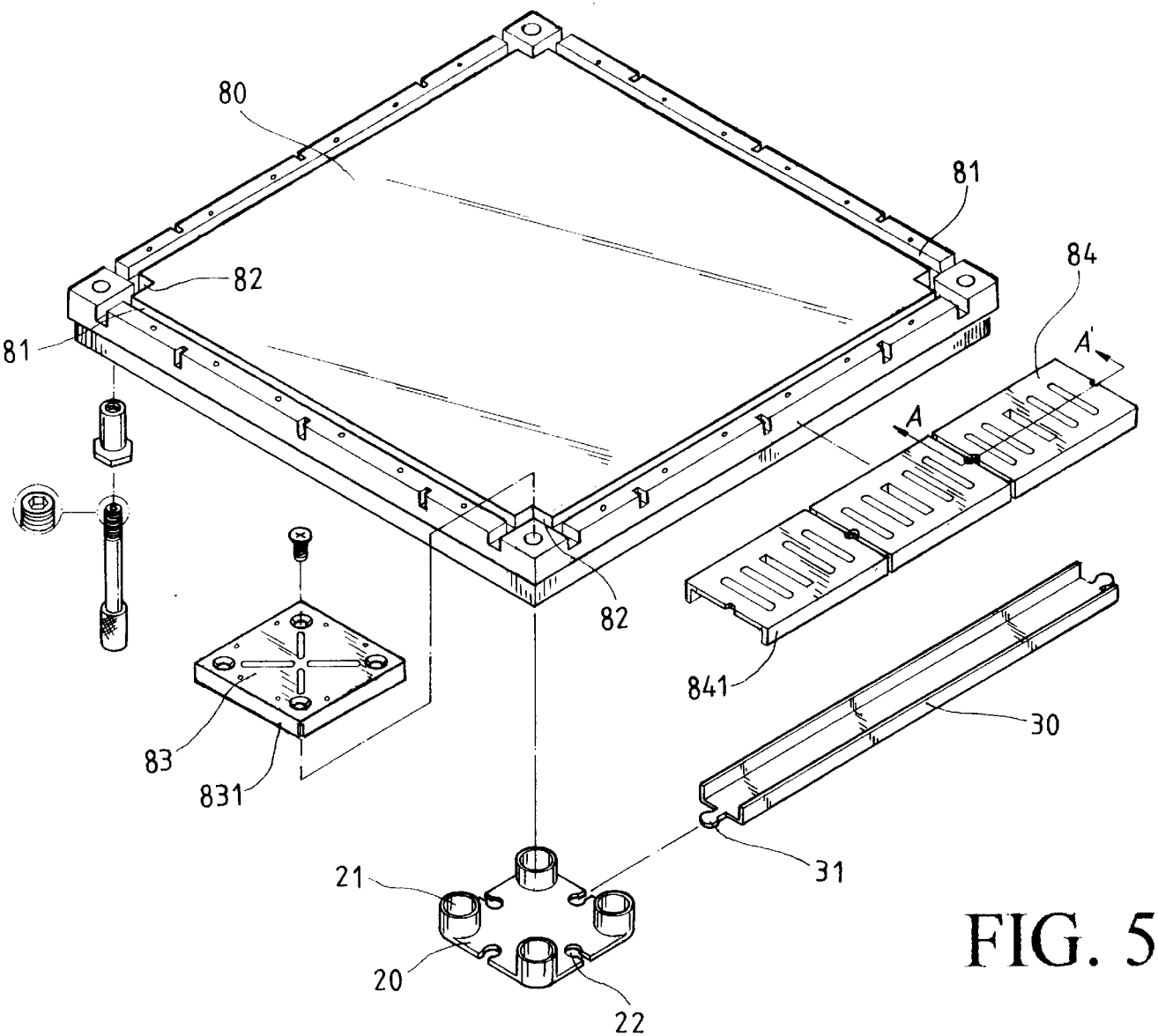
FIG. 5 is a schematic view of another embodiment in the present invention.
Figure 6:
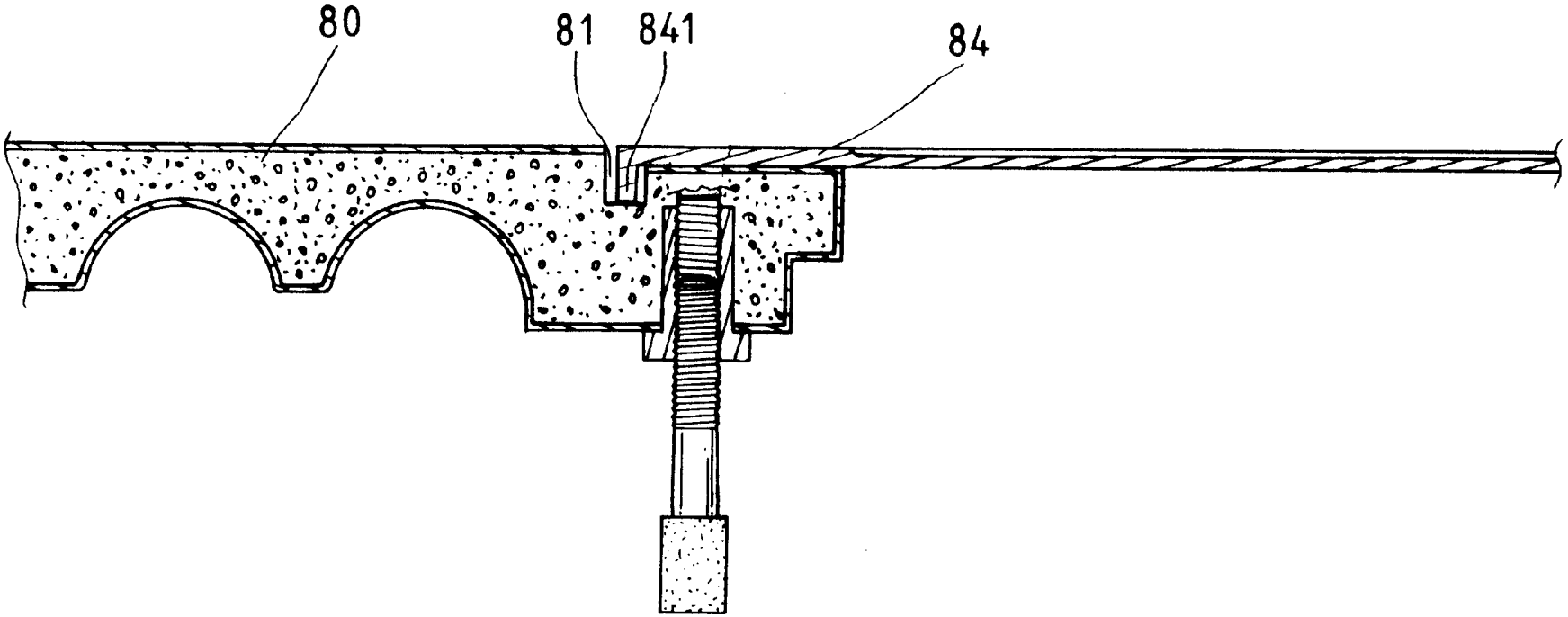
FIG. 6 is a transverse cross sectional view of the embodiment in FIG. 5 after assembling.

Now referring to FIGS. 5 and 6, the structural characteristics of the present invention can include a structure of floor plate body 80 with high frames. Side locking grooves 81 are formed on the periphery of the floor plate body 80, and two corner locking grooves 82 are arranged on the four corners of the floor plate body 80 extending from the grooves 81. Meanwhile, locking rims 831 and 841 are provided respectively on the proper portion of central cover 83 and long side cover 84. Thereby, during the assembly of the network floor, the grooves and locking rims can be connected together to thus form a secure combination.

Figure 7:
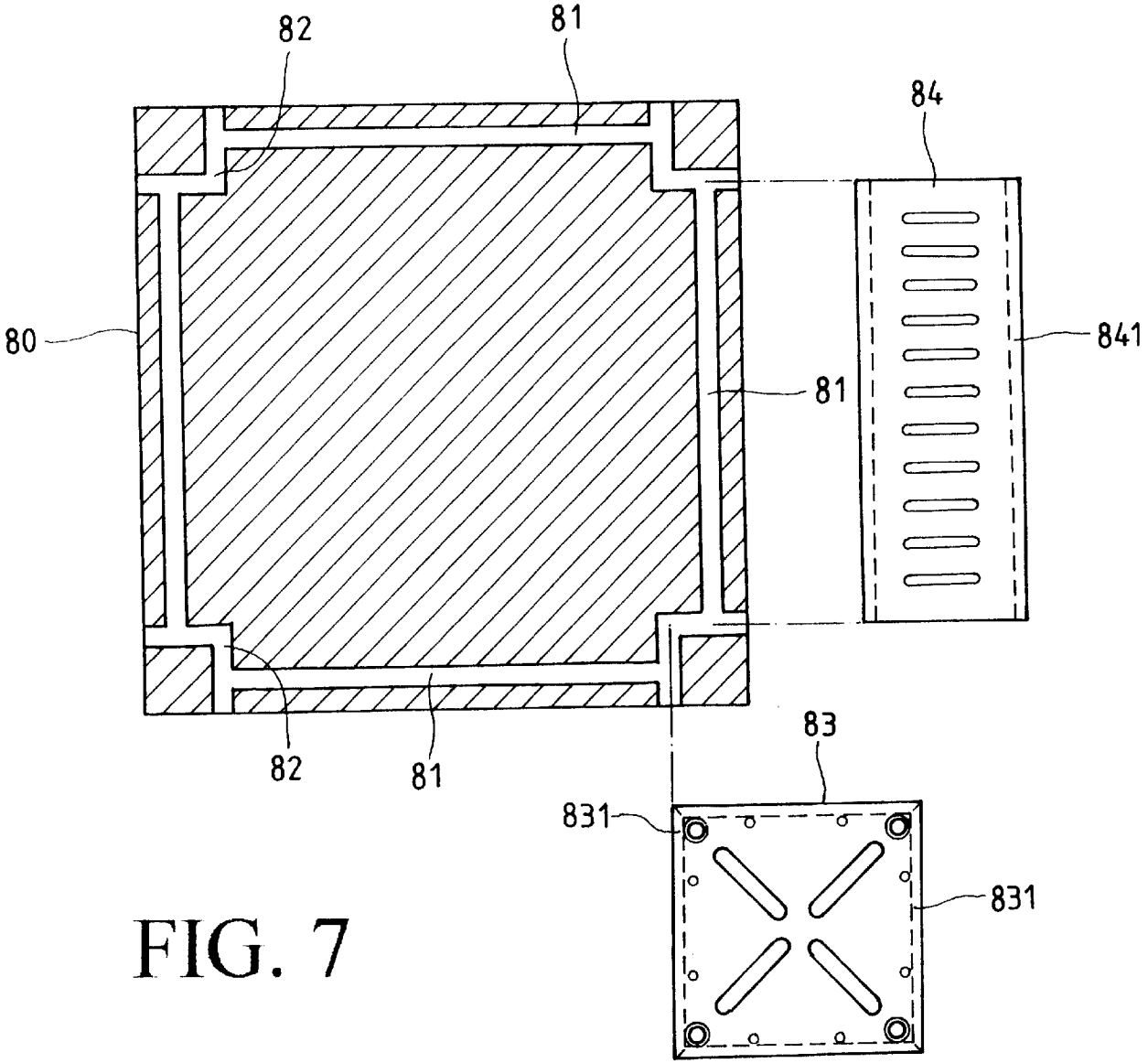
FIG. 7 is an elevational view of the floor unit in the present invention.

FIG. 7 is a plane view that shows the characteristics of the side locking grooves 81 and the corner locking grooves 82 on the floor plate body 80 of the network floor. As shown in the figure, the side locking grooves 81 are arranged along the periphery of the floor plate body 80 for combining and connecting the long side cover 84 by fitting the locking rim 841 into the side locking grooves 81. Similarly, the locking rim 831 on the periphery of the central cover 83 fits into the corner locking grooves 82 near the four corners of the plate body 80, whereby a network floor structure having an excellent and superior stability is provided.

The structure described hereinabove provides a network floor including a connecting structure of the cover plate of a network floor, wherein the finishing procedure is simplified and the efficiency is improved, and a large area can be covered by the structure of the present invention, which structure has a preferred strength for preventing bending.

Although certain preferred embodiments of the present invention have been shown and described detail, it should be understood that various changes and modifications may be therein without departing from the scope of the appended claims.

What is claimed is:

1. A connecting structure of a network floor comprising a floor support, a connecting base, a line groove base, a central cover, and a long side cover that are connected and combined together;

said central cover having locking rims extending downward from a periphery thereof, and said long side cover having continuous locking rims extending downward from long sides thereof for strengthening said long side cover;

said floor support including a top with a frame rim portion arranged about a periphery said top of said floor support, and said frame rim portion including locking grooves;

wherein said locking rims of said central cover and said long side cover engage said locking grooves of two adjacent said floor supports to form a network floor for preventing sliding and deformation of said network floor.

2. The connecting structure of a network floor as claimed in claim 1, wherein said locking grooves include corner locking grooves arranged in four corners of said frame rim portion of said floor support, and said locking rims of said central cover engage said corner locking grooves of two adjacent said floor supports.

3. The connecting structure of a network floor as claimed in claim 1, further comprising a metal main cover having locking rims extending downward from a periphery thereof, wherein said floor supports are integrally formed and have a hollow portion, a center portion with a central pillar, and a strip plate connecting said frame rim portion with said central pillar, and said locking rims of said metal main cover engage said locking grooves of said floor supports.

4. A connecting structure of a network floor comprising a floor support, a metal main cover, a connecting base, a line groove base, a central cover, and a long side cover that are connected and combined together;

said metal main cover having locking rims extending downward from a periphery thereof, said central cover having locking rims extending downward from a periphery thereof, and said long side cover having continuous locking rims extending downward from the two long sides thereof for strengthening said long side cover;

said floor support being integrally formed and having a top, a frame rim portion arranged about a periphery said top, a hollow portion, a center portion with a central pillar, a strip plate connecting said frame rim portion with said central pillar; and said frame rim portion including side locking grooves arranged on sides thereof and corner locking grooves arranged in four corners of said frame rim portion, wherein said locking rims of said metal main cover and said locking rims of said long side cover engage said side locking grooves of two adjacent said floor supports and said locking rims of said central cover engage said corner locking grooves of two adjacent said floor supports to form a network floor for preventing sliding and deformation of said network floor.

5. A connecting structure of a network floor comprising a floor plate body, a connecting base, a line groove base, a central cover, and a long side cover that are connected and combined together;

said central cover having locking rims extending downward from a periphery thereof, and said long side cover having continuous locking rims extending downward from long sides thereof for strengthening said long side cover;

said floor plate body including a top with a periphery having locking grooves;

wherein said locking rims of said central cover and said long side cover engage said locking grooves of two adjacent said floor plate bodies to form a network floor for preventing sliding and deformation of said network floor.

6. The connecting structure of a network floor as claimed in claim 5, wherein said locking grooves of said include side locking grooves arranged on sides of said floor plate body and corner locking grooves arranged in four corners of said floor plate body, and said locking rims of said long side cover engage said side locking grooves two adjacent said floor plate bodies and said locking rims of said central cover engage said corner locking grooves of two adjacent said floor plate bodies.

* * * * *